US009538865B2

(12) United States Patent
Wegener

(10) Patent No.: US 9,538,865 B2
(45) Date of Patent: Jan. 10, 2017

(54) MANNEQUIN FOR PRESENTING OR PHOTOGRAPHING CLOTHING ARTICLES

(76) Inventor: Jan Wegener, Berlin (DE)

(*) Notice: Subject to any disclaimer, the term of this patent is extended or adjusted under 35 U.S.C. 154(b) by 0 days.

(21) Appl. No.: 13/981,332

(22) PCT Filed: Dec. 21, 2011

(86) PCT No.: PCT/EP2011/073706

§ 371 (c)(1),
(2), (4) Date: Jul. 24, 2013

(87) PCT Pub. No.: WO2012/100886

PCT Pub. Date: Aug. 2, 2012

(65) Prior Publication Data

US 2013/0299526 A1 Nov. 14, 2013

(30) Foreign Application Priority Data

Jan. 28, 2011 (DE) ..... 10 2011 000 401

(51) Int. Cl.
*D06C 15/00* (2006.01)
*A47F 8/00* (2006.01)

(52) U.S. Cl.
CPC ..... *A47F 8/00* (2013.01)

(58) Field of Classification Search
CPC ..... A47F 8/00; A47F 8/02
USPC ..... 223/66–70, 72–74, 84, 120
See application file for complete search history.

(56) References Cited

U.S. PATENT DOCUMENTS 1,221,550 A * 4/1917 Luery ..... 223/68
1,271,890 A * 7/1918 Granger ..... 223/68
2,462,778 A * 2/1949 Rosen ..... 223/94
2,558,497 A * 6/1951 Rosen ..... 223/68
2,748,999 A * 6/1956 Freedman ..... 223/68
3,713,375 A * 1/1973 Bianchino ..... 396/3
4,805,816 A * 2/1989 Freund ..... 223/66
5,310,099 A * 5/1994 Claas ..... 223/66
5,410,829 A * 5/1995 Schwab et al. ..... 223/66
2004/0200864 A1* 10/2004 Varner et al. ..... 223/66

FOREIGN PATENT DOCUMENTS

BE 412447 11/1935
BR 6701670 2/1989
CN 201282873 8/2008
(Continued)

OTHER PUBLICATIONS

Las Vegas Mannequins—"Ghost Mannequins"—internet page from Dec. 4, 2013 (2 pages), archived permalink at http://web.archive.org/web/20131204080118/http:/www.lvmannequins.com/ghost-mannequins.html.

(Continued)

*Primary Examiner* — Nathan Durham

(74) *Attorney, Agent, or Firm* — JMB David Ben-David

(57) ABSTRACT

The invention relates to a mannequin for presenting or photographing at least one clothing article (K) arranged appropriately on the mannequin (1), with a front side (10) and a back side (11) facing away from the front side (10). It is provided according to the invention that the mannequin (1) has at least one continuous cutout (100, 101) such that the back side (11) of the mannequin (1) is not visible in a plan view of the front side (10) of the mannequin (1) from a predefinable line of sight (3) in the area of at least one cutout (100, 101).

11 Claims, 14 Drawing Sheets

(56) References Cited

FOREIGN PATENT DOCUMENTS

| | | |
|---|---|---|
| DE | 9011483 | 10/1990 |
| DE | 20216454 | 3/2003 |

OTHER PUBLICATIONS

Bustos, L, "Product Photography: How to Achieve the Ghost Mannequin Effect," GetElastic.com, Jul. 10, 2008 (4 pages), archived permalink at http://www.getelastic.com/product-photography-how-to-achieve-the-ghost-mannequin-effect/.

* cited by examiner

MANNEQUIN FOR PRESENTING OR PHOTOGRAPHING CLOTHING ARTICLES

CROSS-REFERENCE TO RELATED APPLICATIONS

This is the U.S. National Stage of International Application No. PCT/EP2011/073706, filed Dec. 21, 2011, which was published in English under PCT Article 21(2), which in turn claims the benefit of Germany Patent Application No. 10 2011 000 401.7, filed Jan. 28, 2011.

FIELD

The invention relates to a mannequin in accordance with the preamble of claim 1.

This type of mannequin (also called doll, display dummy, etc.) is designed to present or respectively photograph at least one article of clothing appropriately draped on the mannequin, wherein the mannequin is based on at least one section of a human body, i.e. the mannequin does not have to represent the entire body of a human. Furthermore, the mannequin has a front side and a back side turned away from the front side, which together define a surface of the mannequin visible from the outside.

BACKGROUND

Mannequins of the initially named type are used in multiple manners for the presentation of items of clothing and accessories in display windows and display cases, at exhibitions and in other media (e.g. Internet, print media).

The growing product variety in the fashion industry on the one hand and the constantly growing cost pressure on the other hand represent a great challenge for fashion designers and retailers. Through an improved presentation of articles of clothing in sales, a potential buyer can be more effectively pointed to new products and motivated to purchase a product. Thus, the development of new presentation means in the fashion industry has considerable significance.

SUMMARY

As already mentioned, mannequins of the aforementioned type are used in particular in the production of advertising, e.g. for online sale on the Internet or in print media. This requires the creation of sophisticated photos of the respective clothing article.

In this regard, the present invention is thus based on the object of creating a mannequin for presenting or respectively photographing articles of clothing to be advertised, which enables the most efficient process for creating photo material of the respective article of clothing.

This object is achieved through a mannequin with the characteristics of claim 1.

According to it, it is provided that the mannequin has in the area of a clothing article cutout of a clothing article arranged appropriately on the mannequin at least one in particular continuous cutout (in terms of a recess), e.g. connecting the front side with the back side, such that the back side of the mannequin is not visible in a plan view of the front side of the mannequin along a predefined line of sight (in particular optical axis of a used camera) in the area of at least one cutout, i.e. completely hidden by the front side of the mannequin or respectively by the clothing article so that one can effectively look through or respectively over and past the mannequin in the area of the at least one cutout.

It is hereby thus possible in principle to arrange a clothing article, which has a clothing article cutout, e.g. for the neck of a person or for other body parts (t-shirt, shirt, buttoned jacket, turtleneck, pants waistband, taps for sports jackets, etc.) appropriately on the mannequin such that an edge area of the clothing article framing the clothing article cutout lies on an edge area framing the cutout of the mannequin, however the mannequin can no longer be seen in the said plan view since it is now completely hidden by the said clothing article in the area of the cutout. The said clothing article cutouts can also be in particular taps of sport jackets (suit coats) (front edge between the bottom-most button and the hem) or other openings and cuts/cutouts of clothing articles.

The invention has the advantage that in a relatively short period of time neutral photos can be created from the plan view of the clothing article defined above, in which the clothing article is shaped by the mannequin lying below it, but the mannequin is not visible at least in the area of the clothing article cutout (in the plan view). The otherwise common time-intensive and cost-intensive post-processing of photos, with which e.g. the cutout of a conventional mannequin sticking out of a clothing article cutout is normally digitally removed (retouched) for obtaining a neutral representation of the clothing article (without visible mannequin), can thus be omitted or at least considerably simplified.

It is preferred that the front side and the back side (also called front and back wall) of the mannequin each have an outward facing visible outside and an inside facing away from the respective outside, wherein the two insides face each other (the mannequin is thus at least designed partially hollow in sections), and wherein the said at least one cutout is at least designed in particular such that the inside of the back side in the said plan view of the front side of the mannequin is not visible in the area of the at least one cutout, i.e. it is completely hidden by the front side.

Furthermore, in particular the part of the cutout allocated to the back side of the mannequin is at least as large in area as the part of the cutout allocated to the front side of the mannequin. This ensures that, in the case of a plan view of the front side of the mannequin, the back side or respectively the inside of the back side of the mannequin is not visible in the area of the cutout. Currently, the front side and the back side of the mannequin can naturally be determined randomly, i.e. the front side of the mannequin can be the side of the mannequin that comprises the chest but also the side that comprises the back of the mannequin. The back side is then the respective other side of the mannequin.

Furthermore, a plan view of the front side along a predefinable line of sight is understood in particular as a view from a horizontal direction normally to the front side, with respect to an appropriately arranged state of the mannequin, in which the torso of the mannequin and/or its legs substantially extend vertically. The line of sight can also have an incline compared to the perpendicular or respectively horizontal plane.

In one variant of the invention, the at least one cutout of the mannequin in an upper area of the thorax (ribcage) of the torso (neck area) is designed so that in particular in the case of a clothing article arranged appropriately on the mannequin, which forms a clothing article cutout for the neck of a person in the area of the thorax, in the case of a plan view of the front side of the mannequin in the area of the thorax or respectively clothing article cutout, the most that is visible is the inside of the clothing article on the back side of the mannequin (if present), but not the mannequin itself.

The at least one cutout can have all imaginable contours that can occur for articles of clothing. In particular, the at least one cutout can have an edge section (part of the contour), which corresponds with popular shapes in fashion. This hereby involves rounded, curved edge sections, V-shaped edge sections or also in sections straight (linear) edges.

In one variant of the invention, it is provided that the mannequin has a circumferential neck area coming from the torso (mainly based on a human neck area), which frames the at least one cutout of the mannequin, wherein the neck area preferably has a first edge section allocated to the front side and a second edge section connected with it allocated to the back side of the mannequin, which frames the at least one cutout, and wherein in particular the second edge section runs—with respect to an appropriately arranged state of the mannequin—at least in sections below the first edge section along the vertical (drawn downward) so that in particular in the case of a clothing article appropriately arranged on the mannequin that forms a clothing article cutout for the neck of a person in the neck area, in the case of the plan view of the front side of the mannequin diagonally from above in the neck area, the inside of the clothing article (e.g. a turtleneck pullover) is visible on the back side of the mannequin (if present), but not the mannequin or respectively its back side itself. An insert is also preferably provided for closing said cutout, which is releasably fixable in the neck area.

In a further variant of the invention, it is provided that the mannequin has at least or only one pelvis and, if applicable, two legs extending from it, wherein the at least one cutout is framed by a circumferential pelvis area (parallel to the waist) of the display dummy. The pelvis area preferably thereby has a first edge section allocated to the front side of the display dummy and a second edge section connected with it and allocated to the back side of the display dummy, wherein the two edge sections limit at least one cutout, and wherein in particular the second edge section runs—with respect to an appropriately arranged state of the mannequin—at least in sections below the first edge section along the vertical (drawn downward) so that in particular in the case of a clothing article appropriately arranged on the mannequin, which in the pelvis area forms a clothing article cutout for the pelvis/stomach of a person, in the plan view of the front side of the mannequin from diagonally above in the pelvis area, the inside of the clothing article (e.g. pants) is visible on the back side of the mannequin (if present), but not the mannequin or respectively the back side itself. Furthermore, it is preferably provided that the mannequin has an insert for closing the said cutout, which is releasably fixable on the pelvis area.

In a further variant of the invention, the at least one cutout is designed in the area of the pelvis of the torso, wherein in particular the at least one cutout narrows in a section on the front and/or back side of the mannequin in the direction towards the thorax, namely in a V-shape, wherein each section can extend up to the area of the stomach of the torso of the mannequin. In the case of a clothing article arranged appropriately on the mannequin, which forms a clothing article cutout (tap of a sports jacket or jacket, etc.) in the area of the pelvis, in the case of a plan view of the front side of the mannequin in the area of the pelvis or respectively in the area of the clothing article cutout, the most that is visible is the inside of the clothing article on the back side of the mannequin (if present), but not the mannequin itself, which is completely hidden by the clothing article in the area of the clothing article cutout.

In particular, said cutout in the pelvis area can extend up to two upper thigh areas of two legs coming off the torso in order to be able to realize the effect according to the invention over the largest possible image section downwards.

Naturally, the previously presented types of cutouts can be combined with each other in all imaginable variants in order to create the most universally usable mannequins. The mannequins according to the invention can thereby have a unisex shape or be mainly based on a masculine or feminine body.

For the (variable) closure of a part of the said cutout in the pelvis area of the mannequin on the front side of the mannequin, a mainly triangular insert is also preferably provided, which is releasably fixed and substantially positive-fitting in the narrowing section of the cutout. Such an insert straightens the V-shaped cutout in the pelvis area and can be used in particular for clothing articles that have more of a straight, horizontally running edge in the pelvis area, other than sports jackets, which have more of a V-shaped clothing article cutout in the pelvis area due to their cut and the buttoning (e.g. tap).

Furthermore, the mannequin has at least one insert releasably fixable in the cutout for reducing and/or changing a contour of a cutout in the thorax or respectively neck area, which in turn—together with the at least one cutout or alone—can define a smaller (in terms of area) cutout but can also close the at least one cutout.

In this respect, the mannequin can also have a plurality of inserts for variably reducing and/or changing a contour of said cutouts, wherein a first of these inserts is releasably fixable in the at least one cutout and each further insert on at least one neighboring insert. In this manner, the at least one cutout can be successively reduced through the fixing of corresponding inserts or respectively its shape can be adjusted for the specified clothing article cutouts. A modular mannequin concept is hereby created in which a plurality of different clothing article cutouts can be (neutrally) photographed in a short period of time with just one mannequin without requiring digital post-processing of the photos to a considerable extent.

In order for the inserts to be quickly changed, magnet connections are preferably provided, via which the inserts can be manually and releasably arranged or respectively fixed in a cutout. For this, magnet elements appropriately positioned from the inside of the mannequin can be arranged on the insert and/or the circumjacent front or respectively back side of the mannequin.

In order for a clothing article appropriately arranged on the mannequin to be photographed particularly effectively, it is also preferably provided that the mannequin is pivotably mounted on a carrier plate around a vertical axis, wherein the carrier plate has in particular a plurality of rollers (e.g. four rollers) for moving the mannequin, via which the carrier plate can lie on a base (floor). If necessary, the rollers can be locked individually by means of a respectively allocated brake.

In order to prevent, in the case of comparatively large-area cutout, edge areas of a clothing article cutout from nestling in the cutout and contours of the cutout thus becoming visible through the respective clothing article, an air movement device (e.g. blower, fan, etc.) is arranged in an interior space of the mannequin defined by the mannequin, which is designed to generate a (variable) air flow flowing out of the at least one cutout. This pushes the corresponding edge areas of the said clothing article cutout outward and thus prevents a contour of the cutout of the mannequin from showing on the clothing article.

Finally, a further inventive idea relates to an arrangement with a mannequin according to the invention and a clothing article appropriately arranged on it, wherein all clothing articles especially—as described above—are each arranged on the mannequin such that a clothing article cutout is to lie on a corresponding cutout of the mannequin such that in particular in the plan view respectively in the area of the clothing article cutout, the most that is visible is the clothing article, in particular its inside on the back side of the mannequin, but not the mannequin itself.

It should also be noted that the subject matters of claims 14 and 15 each taken in and of themselves (without referencing previous claims) can be pursued as independent inventions.

BRIEF DESCRIPTION OF THE FIGURES

Further characteristics and advantages of the invention should be explained by means of the below figure descriptions of exemplary embodiments based on the figures. In the figures.

DETAILED DESCRIPTION

Figure 1:
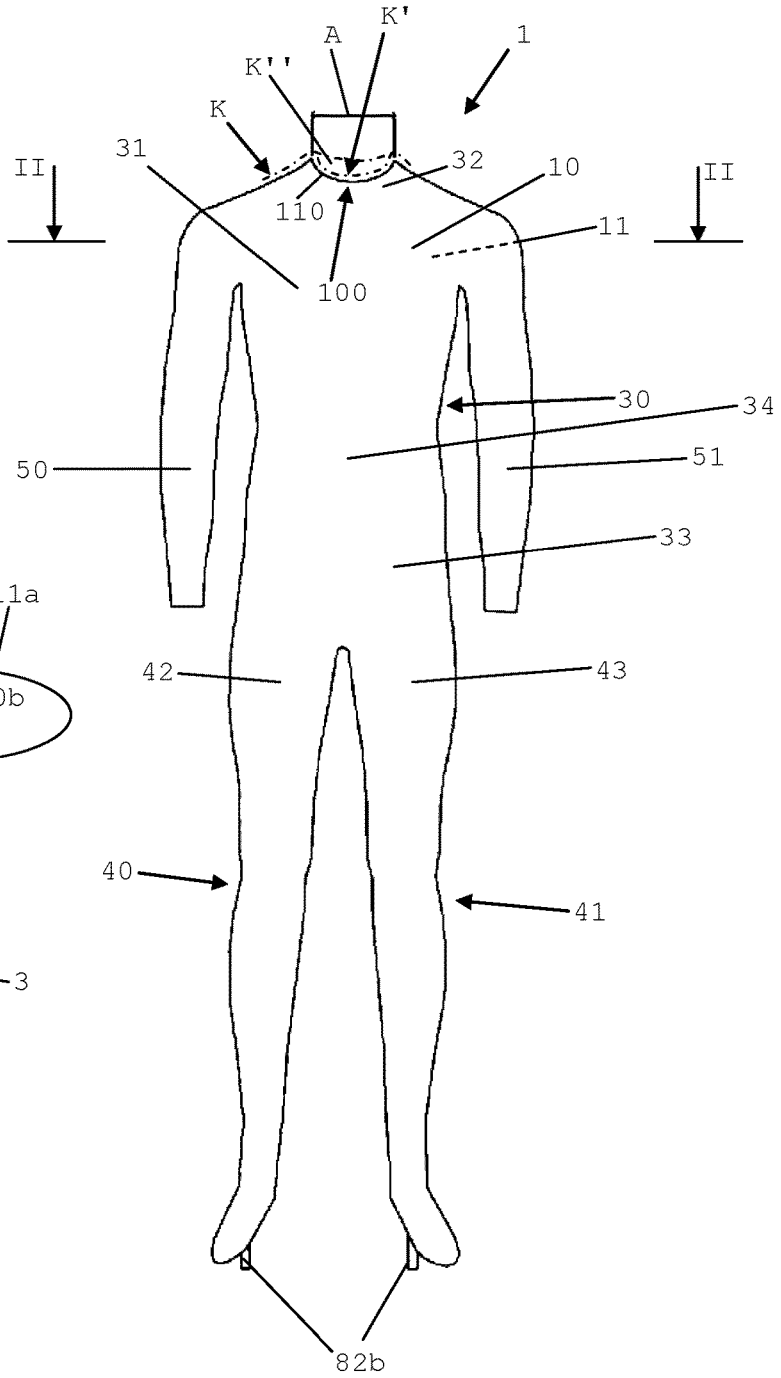
FIG. 1 shows a plan view of the front side of a mannequin according to the invention.
Figure 2:
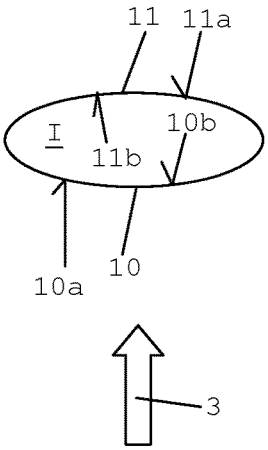
FIG. 2 shows a cut along the line II-II of FIG. 1.

FIG. 1 shows in connection with FIG. 2 a mannequin 1 according to the invention for presenting or respectively photographing at least one clothing article K appropriately arranged on the mannequin 1, which is indicated in sections by a dashed and dotted line.

The mannequin 1 extends—with respect to an appropriately arranged state—vertically and has a torso 30 as well as arms 50, 51 extending from it and vertically extending legs 40, 41. The mannequin 1 is based on a human so that the torso 30 has accordingly a ribcage 31 (thorax), an upper area of the thorax (transition to neck) 32, a stomach 34 and a pelvis 33.

Furthermore, the mannequin 1 has a front side 10 in accordance with FIG. 1 and a back side 11 facing away from the front side 10, which together define the spatial shape of the mannequin.

In accordance with FIG. 2, the front side 10 and the back side 11 of the mannequin 1 each have an outward facing visible outside 10*a*, 11*a* and an inside 10*b*, 11*b* facing away from the respective outside 10*a*, 11*a*. The two insides 10*b*, 11*b* thereby face each other.

For (substantially) post-processing-free photographing of clothing articles K in the area of clothing article cutouts K' (e.g. for the head of a person, etc.) such that the mannequin 1 is not visible, the mannequin 1 in accordance with FIG. 1 has a continuous cutout 100 in an upper area 32 of the thorax 31 on the transition to the neck (not present).

This cutout 100 is thereby designed such that the inside 11*b* of the back side 11 of the mannequin 1 is not visible in a plan view along the line of sight 3 (normally to the front side 10, see arrow in FIG. 2) of the front side 10 or respectively outside 10*a* of the front side 10 of the mannequin 1 in the area of the cutout 100. Thus, as indicated in FIG. 1 with the dashed and dotted line, only one section of an inside K" of the clothing article K is visible in the area of the clothing article cut K' or respectively in the area of the cutout 100 in the said plan view (if present).

Ideally, a post-processing of photos, with which sections of the mannequin must be digitally removed or respectively retouched later in the case of conventional mannequins, of said cutout area is hereby advantageously omitted.

The diameter A of the cutout 100 in accordance with FIG. 1 is preferably 12 cm (the deviations lie here in the range of 1 cm to 4 cm as in the below other examples).

The above concept is also used for further mannequins 1 in accordance with FIGS. 3 through 7 and 9 through 17.

Figure 3:
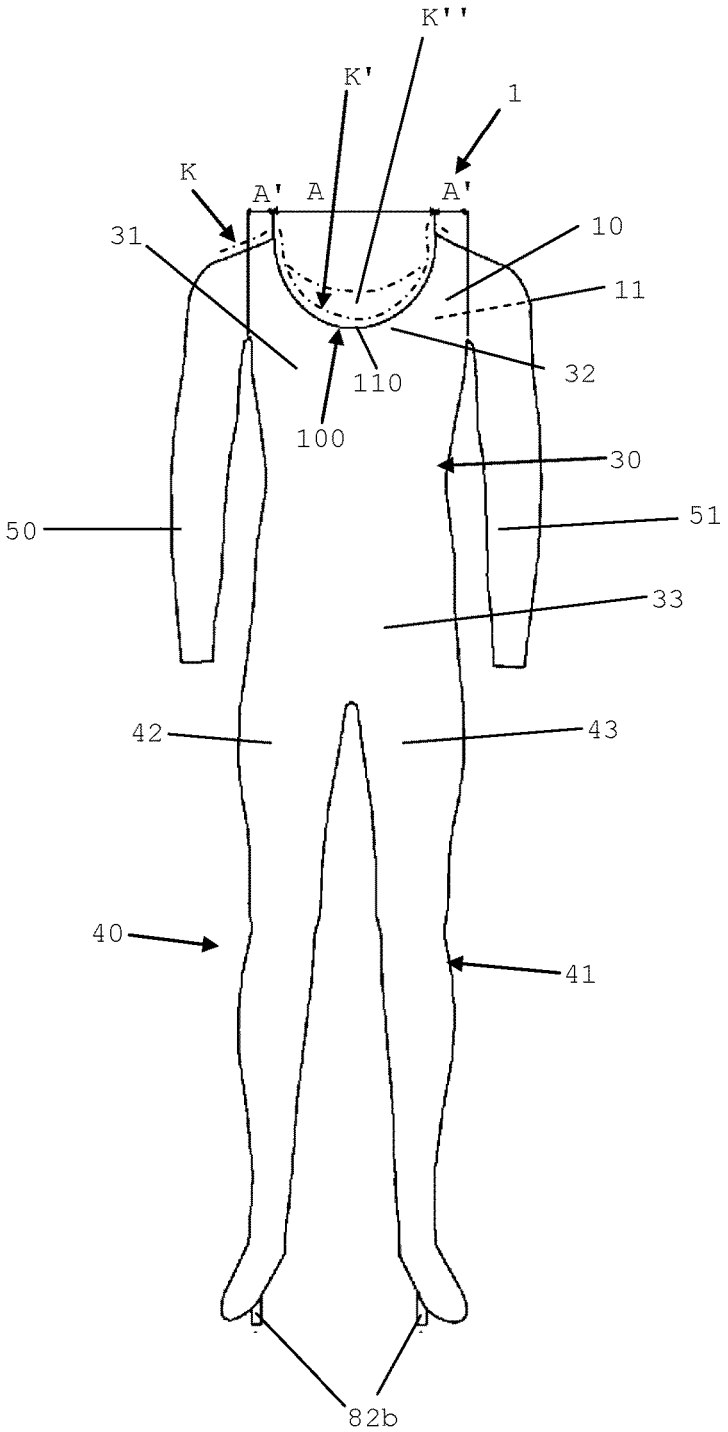
FIG. 3 shows a plan view of the front side of a further mannequin according to the invention.

FIG. 3 shows a plan view of the front side 10 of a further mannequin 1 according to the invention, in which the cutout 100 as in FIG. 1 on the front side 10 has a round edge section 110 or respectively a rounded contour, however wherein the cutout 100 in accordance with FIG. 3 is designed larger in terms of area and extends lower over the chest area 32 of the mannequin 1.

The measures in accordance with FIG. 3 are preferably A=25 cm and A'=3 cm.

Figure 4:
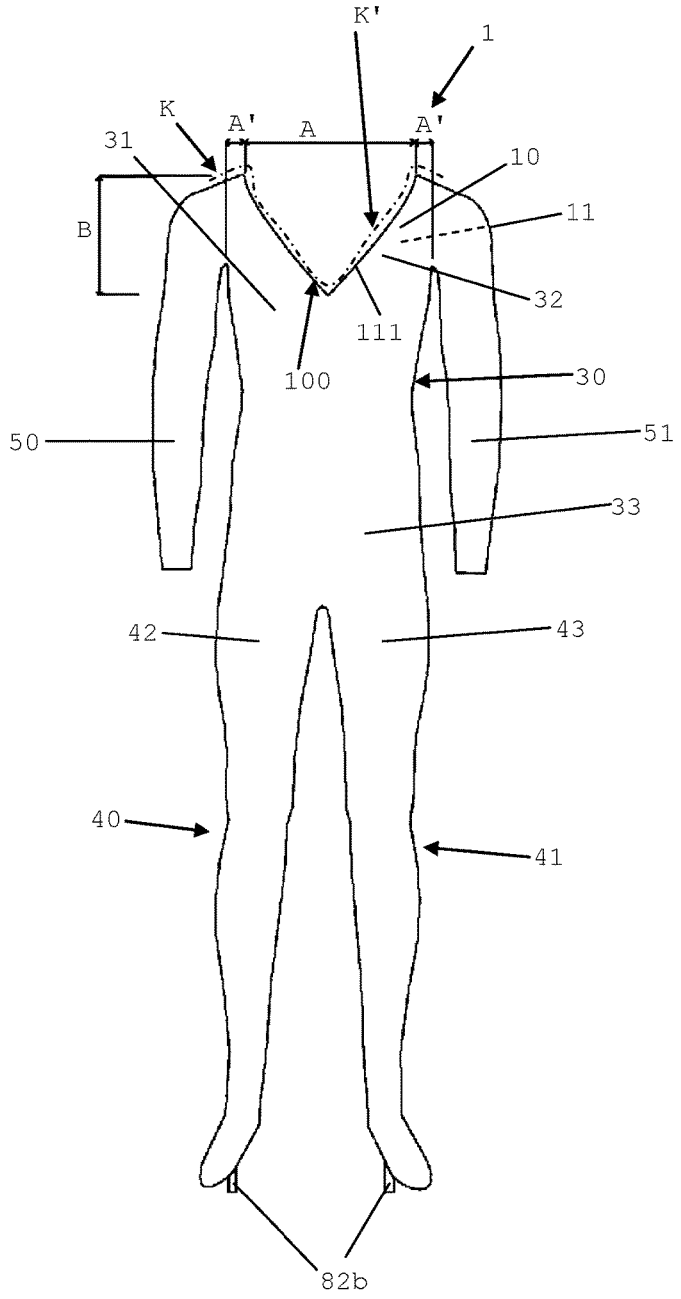
FIG. 4 shows a plan view of the front side of a further mannequin according to the invention.

FIG. 4 shows a plan view of the front side 10 of a further mannequin 1 according to the invention, in which in contrast to FIG. 3, the cutout 100 has a V-shaped edge section 111.

The measures in accordance with FIG. 4 are preferably A=25 cm, A'=3 cm and B=19 cm.

Figure 5:
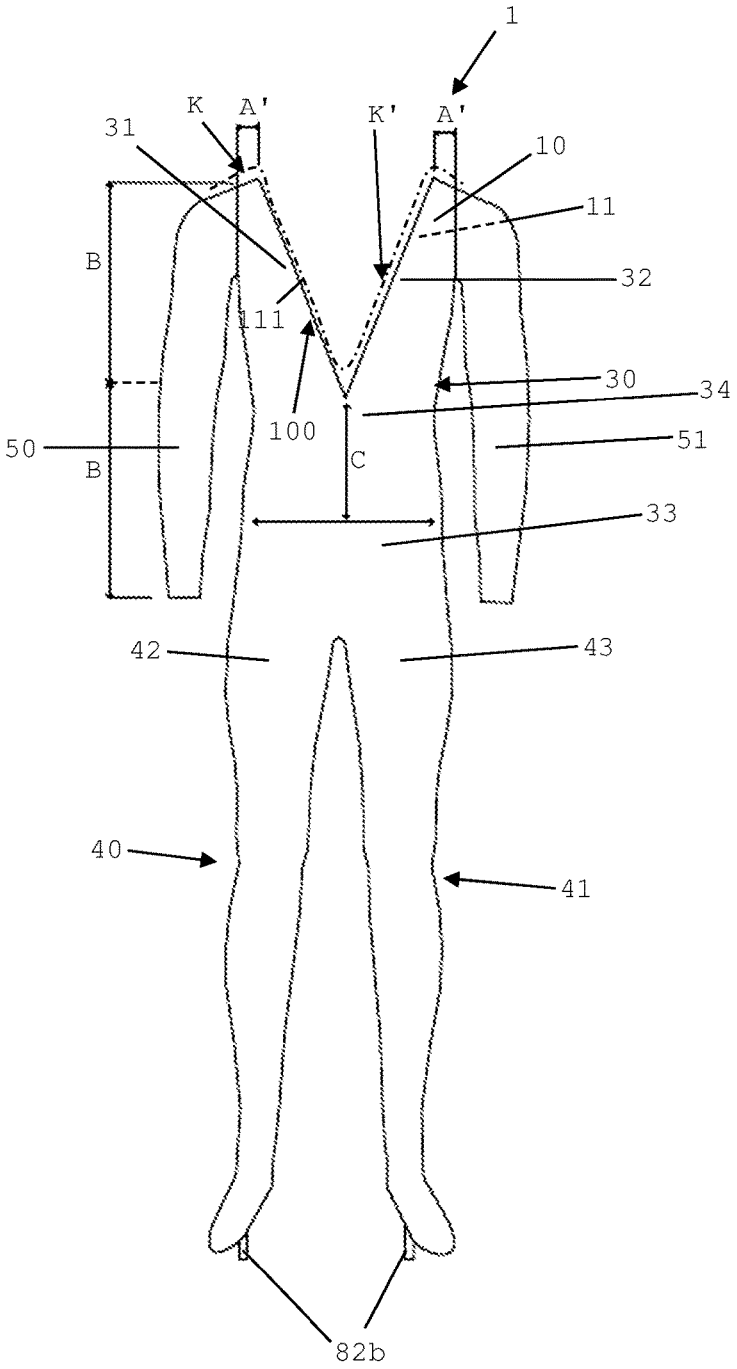
FIG. 5 shows a plan view of the front side of a further mannequin according to the invention.

FIG. 5 shows a plan view of the front side 10 of a further mannequin 1 according to the invention, in which in contrast to FIG. 4 the V-shaped cutout 100 is designed even lower and extends up to the stomach area 34.

The measures in accordance with FIG. 5 are preferably A'=3 cm, B=31 cm and C=19 cm.

Figure 6:
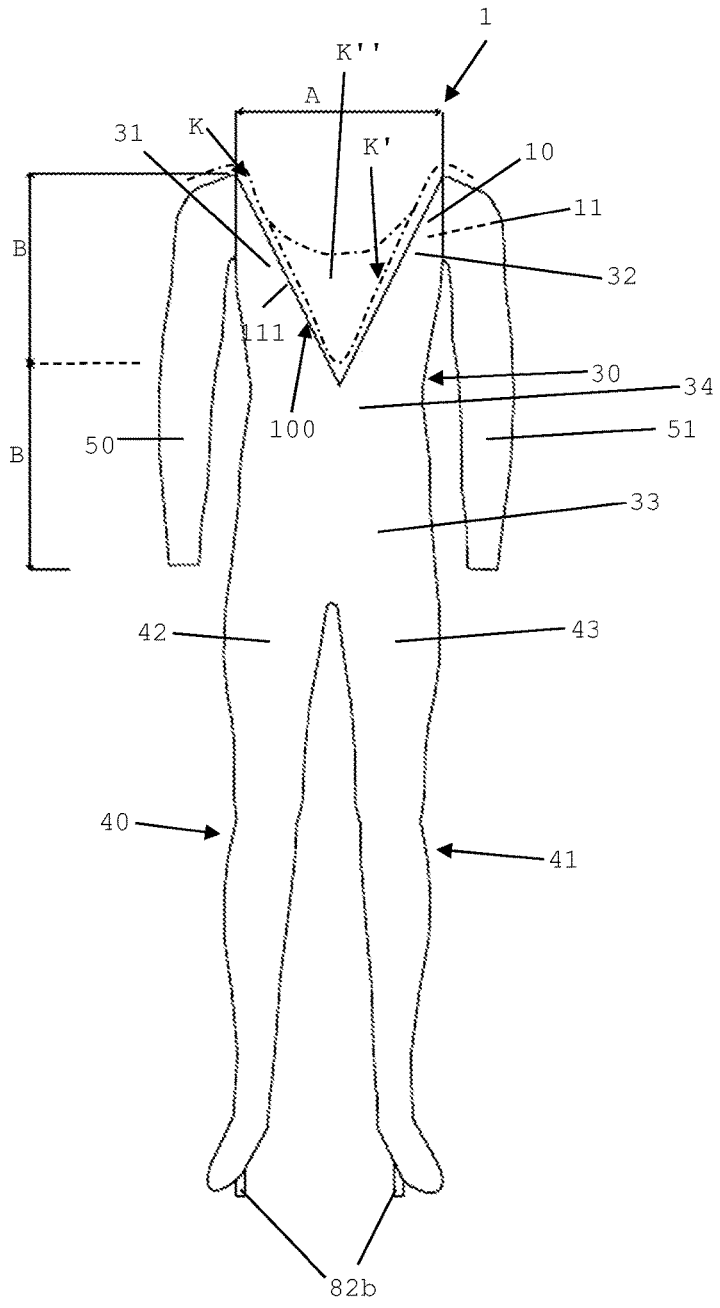
FIG. 6 shows a plan view of the front side of a further mannequin according to the invention.

FIG. 6 shows a plan view of the front side 10 of a further mannequin 1 according to the invention, in which in contrast to FIG. 5 the V-shaped cutout 100 is designed broader.

The measures in accordance with FIG. 6 are correspondingly preferably A=28 cm and B=31 cm.

Figure 7:
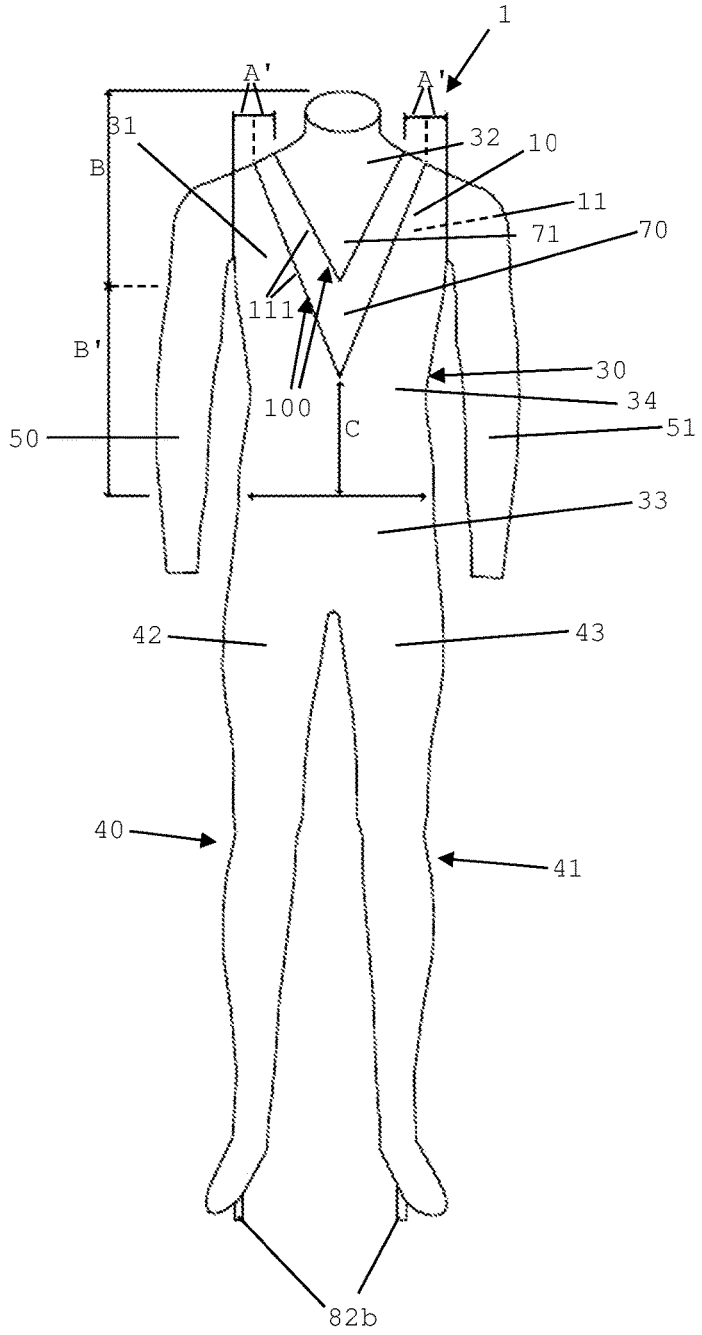
FIG. 7 shows a plan view of the front side of a further mannequin according to the invention.

FIG. 7 shows a plan view of the front side 10 of a further mannequin 1 according to the invention with a cutout 100 with a (low) V-shaped edge section 111, wherein the cutout 100 is closeable with two inserts 70, 71, wherein the first insert 70 is fixable in the cutout 100 on the mannequin 1 such that the cutout 100 is reduced in terms of area, but the V-shape of the edge section 111 of the reduced cutout 100 is retained. This is also true for the reduced cutout 100 that it is designed according to the invention such that in the plan view along the line of sight 3 in accordance with FIG. 2 the back side 11 of the mannequin cannot be seen and thus ideally no post-processing of corresponding photos is needed.

The second insert 71 serves to completely close the remaining cutout 100 and thereby forms an area, which is based on a human neck.

Figure 8:
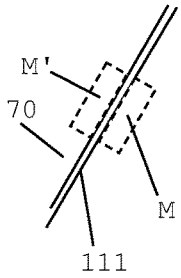
FIG. 8 shows a schematic representation of a magnet connection between an insert and a torso of a mannequin according to the invention.

In accordance with FIG. 8, such inserts 70, 71 are preferably fastened by means of magnet elements M, M' on the torso 30. For this, on a circumferential edge area of an insert 70 or 71, magnet elements M' are provided on the inside of the respective insert 70, 71, which interact in an attractive manner with opposite magnet elements M provided on an edge area 111 of the cutout 100 or respectively of an insert 71. If applicable, as an alternative, the magnet elements M or M' can be paired with metal elements M' or respectively M.

The measures in accordance with FIG. 7 are preferably A'=3 cm, B=19 cm, B'=31 cm and C=18 cm.

Figure 9:
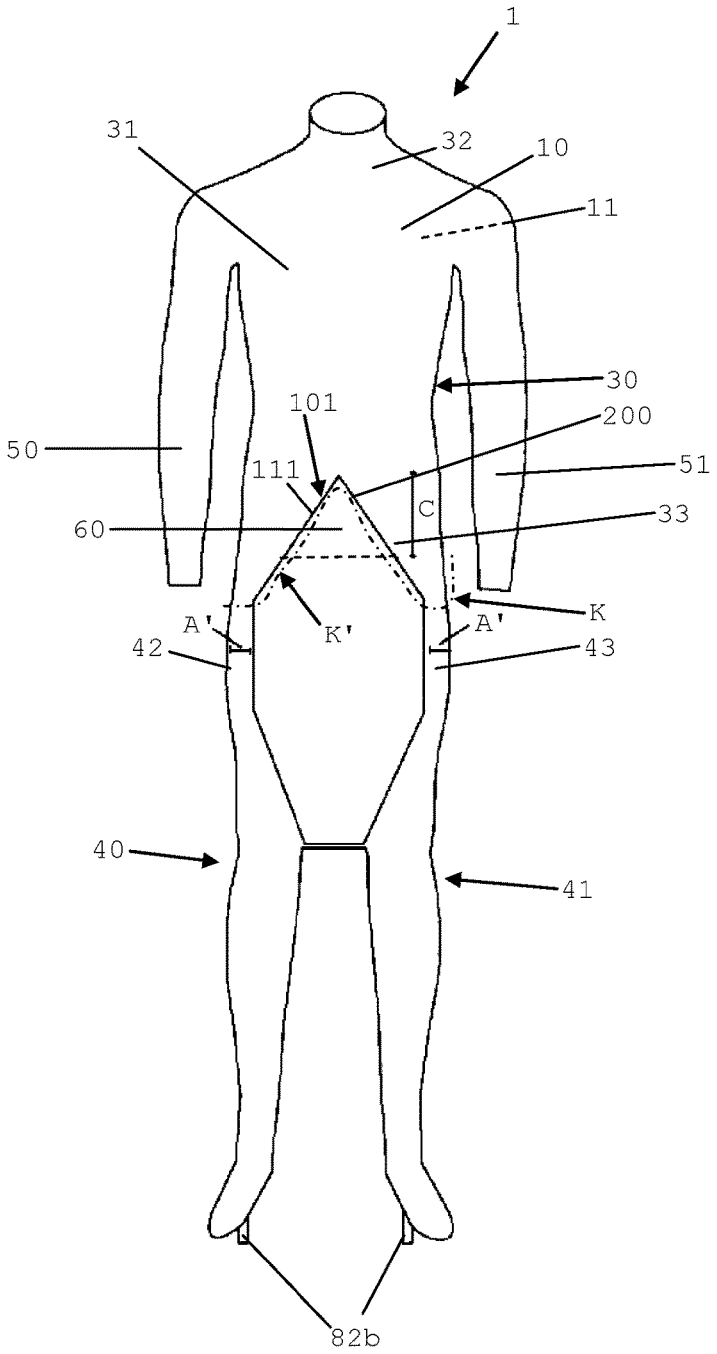
FIG. 9 shows a plan view of the front side of a further mannequin according to the invention.

FIG. 9 shows a plan view of the front side of a further mannequin 1 according to the invention, in which in contrast to the previous FIGS. 1 through 7 a cutout 101 is provided in the pelvis area 33 of the torso 30 of the mannequin 1, which extends up to two upper thigh areas 42, 43 of the legs of the mannequin 1. In particular clothing article cutouts K' of sports jackets and similar clothing articles K can hereby be photographed in the pelvis area 33 in the manner according to the invention without comprehensive post-processing of the image material. For stabilization of the mannequin 1, the two legs 40, 41 can be connected with each other via a bar at the height of the knees below the continuous cutout 101.

The section 101 has in particular a section 200 running in a V-shape in the direction of the stomach area 34, which can be closed on the front side with a triangular insert 60 of the aforementioned type. Magnet connections M, M' in accordance with FIG. 8 can hereby be used. It is provided in particular that the described inserts 60, 70-71 are fixable in the cutouts 100, 101 such that a smooth (stepless) transition is present between the said inserts and the edge areas of the cutouts 100, 101 on the front side 10 and/or back side 11 of the respective mannequin 1.

Figure 10:
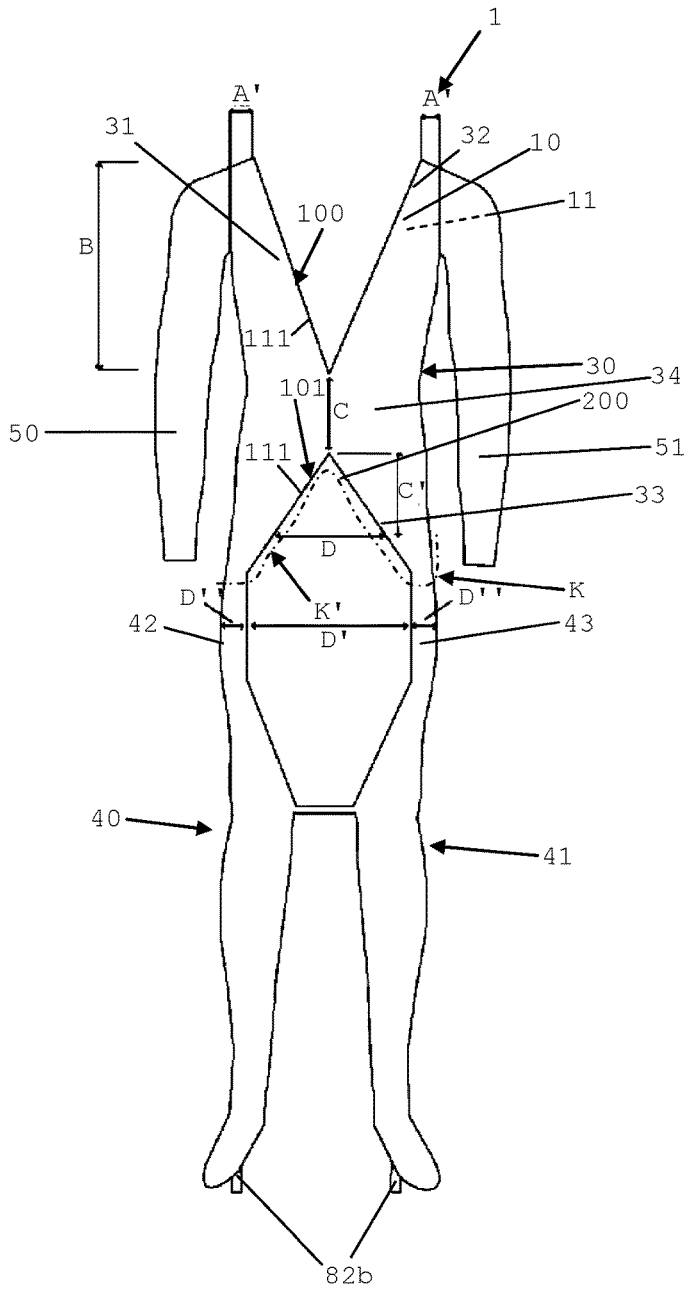
FIG. 10 shows a plan view of the front side of a further mannequin according to the invention.

FIG. 10 shows a combination of cutouts 100, 101 according to the type in FIGS. 5 and 9.

The measures in accordance with FIG. 10 are preferably B=31 cm, A'=3 cm, C=8 cm, C'=13 cm, D=13 cm, D'=20 cm and D"=1-5 cm.

Figure 11:
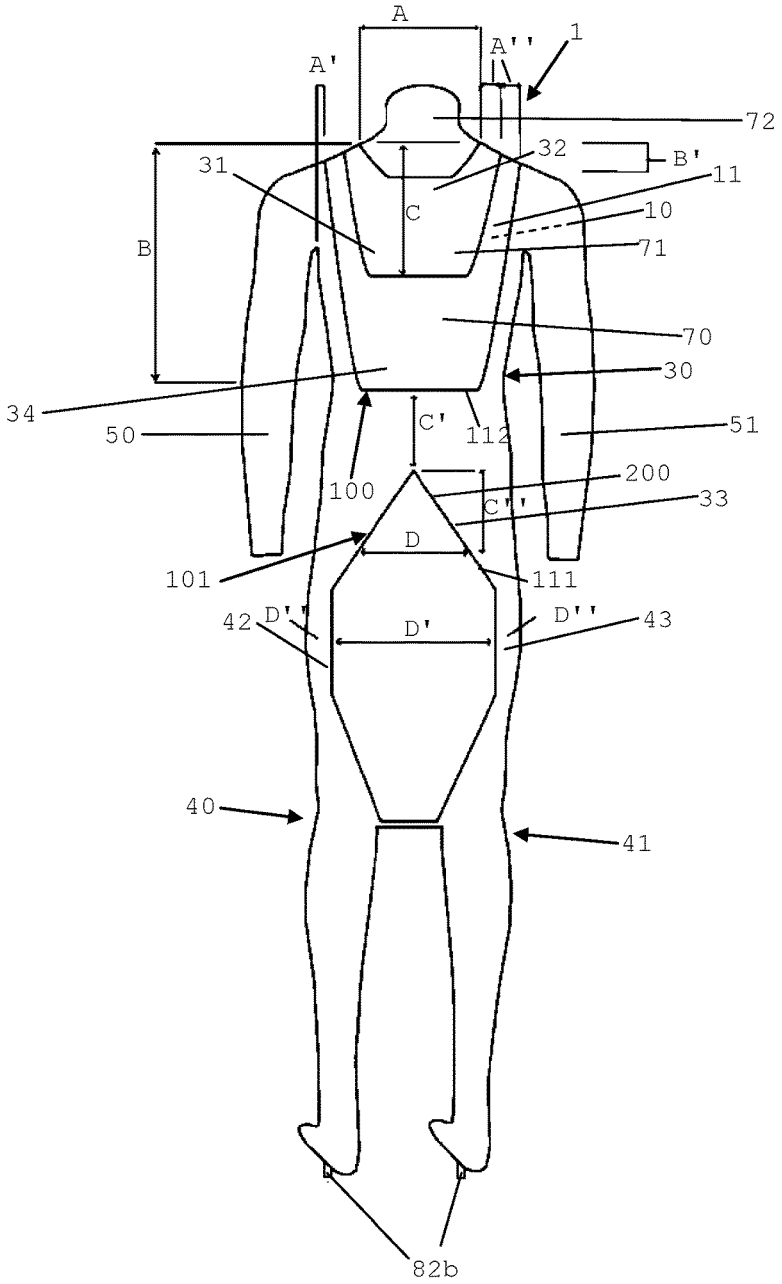
FIG. 11 shows a plan view of the back side of a further mannequin according to the invention.

FIG. 11 shows a plan view of the back side 11 of a further mannequin 1 according to the invention. The cutout 100 thereby has on the back side 11 linear edge sections 112 and can be successively closed by means of inserts 70-72 according to the type in FIG. 7, which respectively reduce the cutout 100, wherein the third insert 72 can completely close the cutout 100 and thereby forms a neck shape based on the human neck.

Furthermore, the mannequin 1 in accordance with FIG. 11 has a cutout 101 according to the type in FIGS. 9 through 10.

The measures in accordance with FIG. 11 are preferably B=32 cm, B'=3-6 cm, A=25 cm, A'=1 cm, A"=3 cm, C=20 cm, C'=7 cm, C"=14 cm, D=14 cm, D'=21 cm, D"=3-6 cm.

Figure 12:
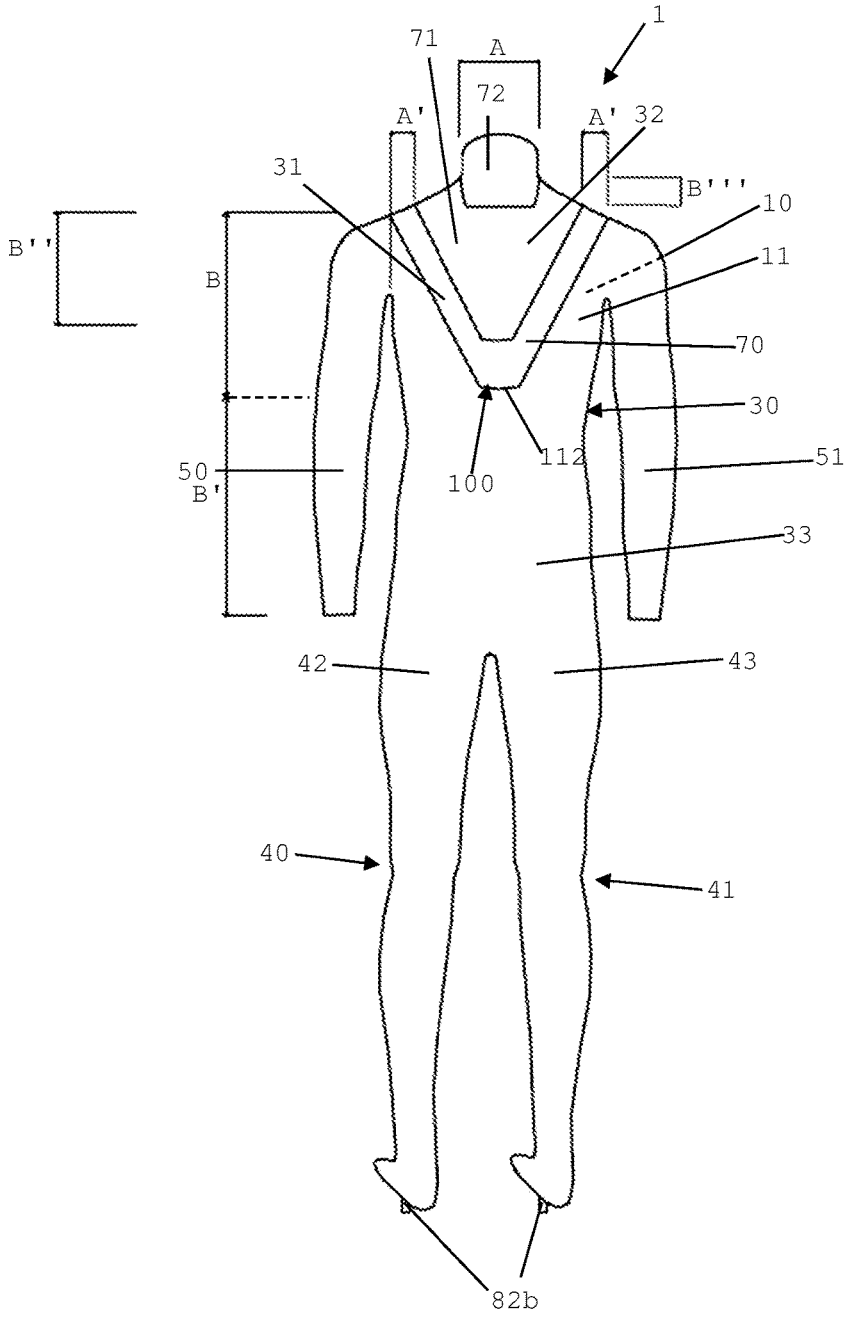
FIG. 12 shows a plan view of the back side of a further mannequin according to the invention and FIG. 13 shows a plan view of the front side of a further mannequin according to the invention.

Finally, FIG. 12 shows a plan view of the back side 11 of a further mannequin 1 according to the invention. The cutout 100 thereby has a blunt V-shape with a substantially linear edge section 112 on the lowest point of the cutout 100. The cutout 100 is furthermore reducible or respectively closable according to the type in FIGS. 7 and 8 by means of three inserts 70-72, wherein the contour of the cutout 100 substantially remains unchanged.

The measures in accordance with FIG. 12 are preferably B=32 cm, B'=31 cm, B"=20 cm, B'"=3-6 cm, A=13 cm, A'=3 cm.

The FIGS. 11 and 12 illustrate that the concept according to the invention can naturally also be used for the back views of clothing articles K. The reference numbers 31 through 33 each identify body parts that correspond with those of the front side.

Figure 13:
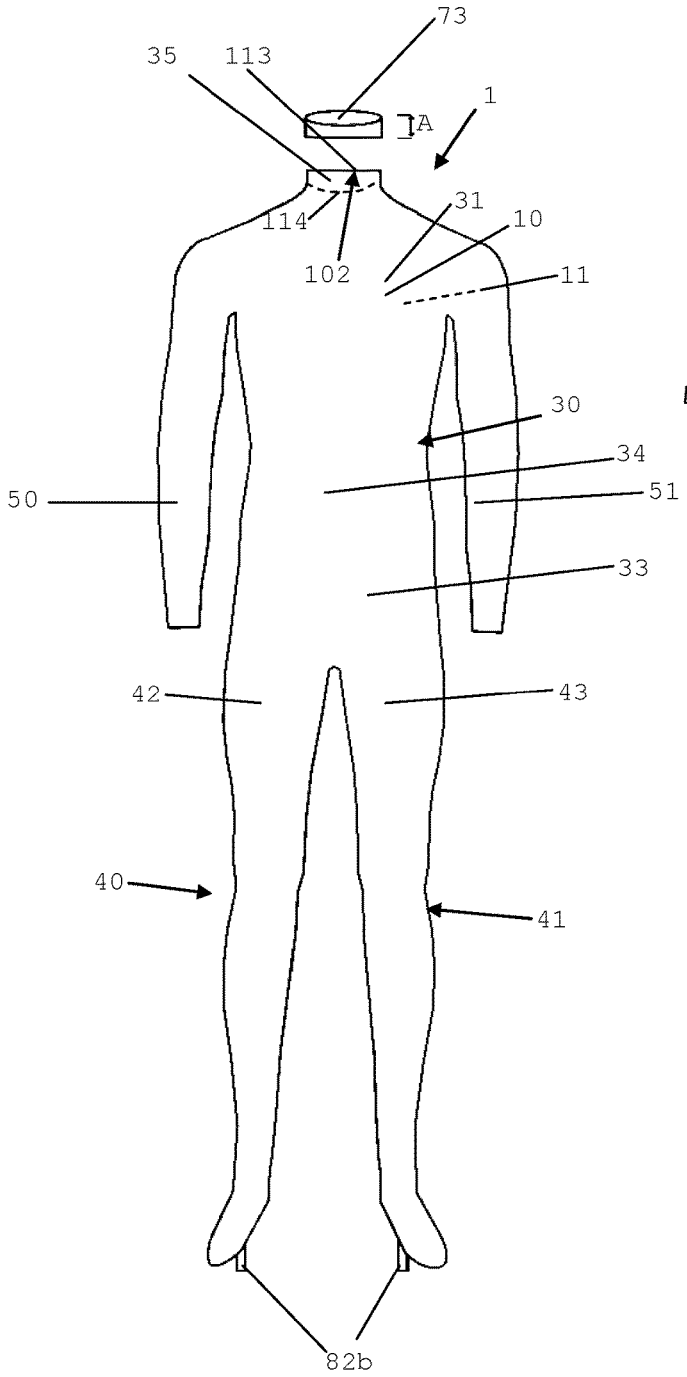
Figure 14:
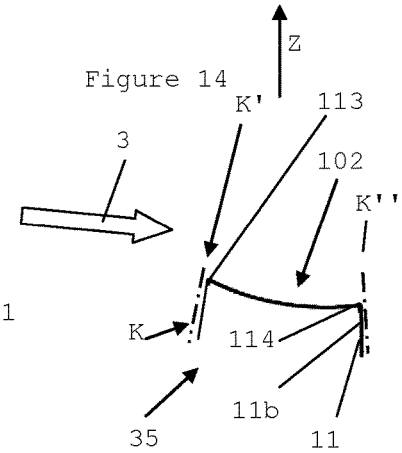
FIG. 14 shows a fragmentary, partially cut side view of the neck area of the mannequin in accordance with FIG. 13.

Furthermore, FIG. 13 shows in connection with FIG. 14 a mannequin 1, which is particularly suitable for taking pictures of the neck cutout of turtleneck pullovers and similar clothing articles K.

The mannequin 1 thereby has a circumferential neck area 35 extending from the torso 30, which frames a cutout 102. The neck area 35 or respectively the cutout 102 has a first edge section 113 allocated to the front side 10 of the mannequin 1 and a second edge section 114 connected with it (annularly) allocated to the back side 11, which go around or frame at least one cutout. The second edge section 114 is now bent along vertical line Z—with respect to an appropriately arranged state of the mannequin 1—and thereby runs at least in sections below the first edge section 113, as can be seen in particular in FIG. 14.

This causes that, in the case of a clothing article K' arranged appropriately on the mannequin 1, which forms a clothing article cutout K' for the neck of a person in the neck area 35 (e.g. turtleneck), in the plan view of the front side 10 of the mannequin along the line of sight 3 in accordance with FIG. 14 ("diagonally from above") in the neck area 35, the inside K" of the clothing article K on the back side 11 of the mannequin 1 is visible, but not the inside 11*b* of the mannequin 1 itself. In accordance with FIG. 13, an insert 73 in the shape of a neck section with a flat (even) cover surface is furthermore provided for closing said cutout 102, which is releasably fixable on the neck area 35, e.g. in accordance with FIG. 8 (see above).

The measure specified in FIG. 13 is preferably A=1-2 cm.

Figure 15:
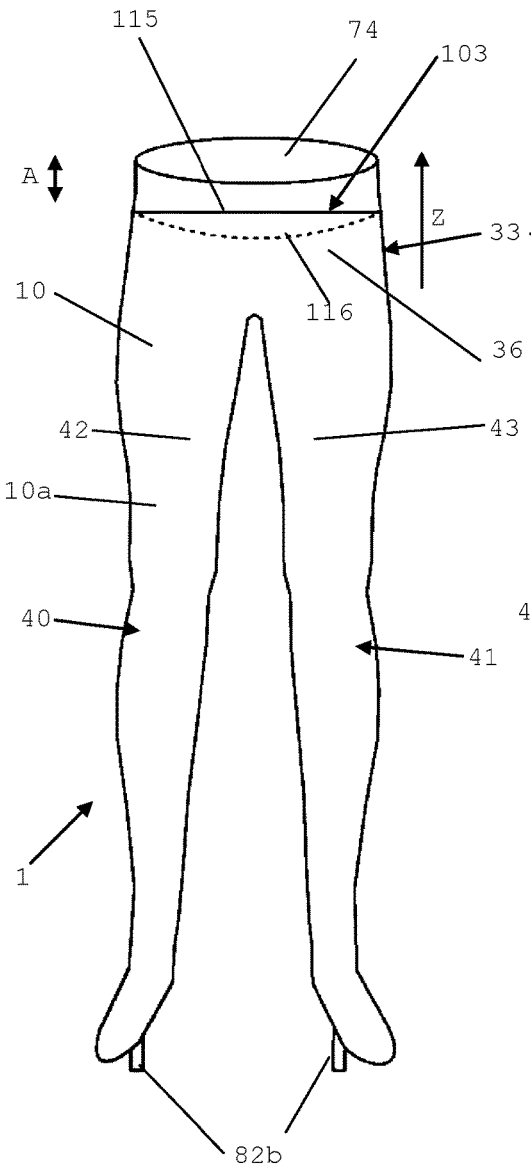
FIG. 15 shows a plan view of the front side of a further mannequin according to the invention.
Figure 16:
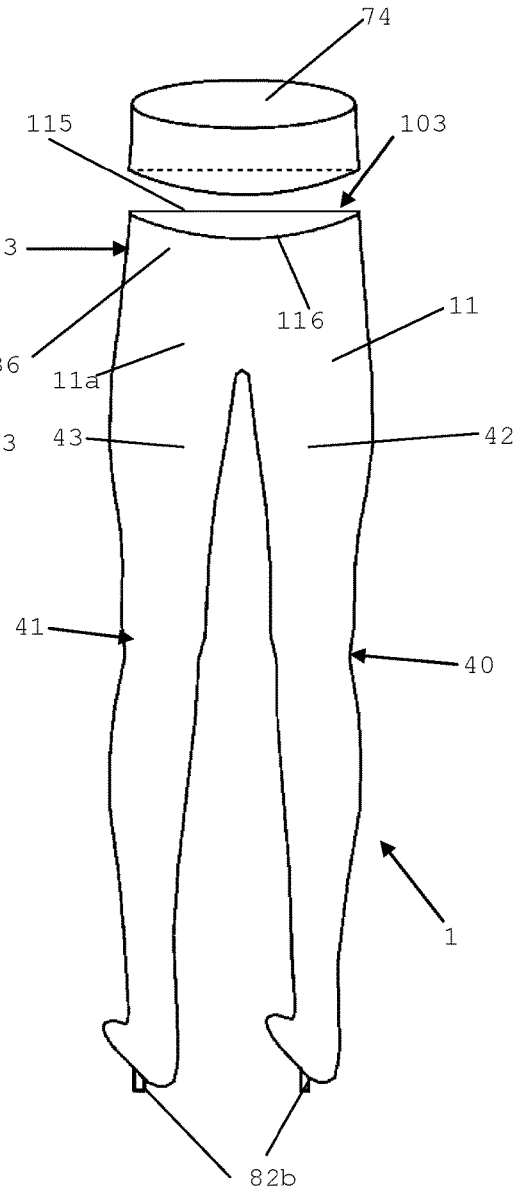
FIG. 16 shows a plan view of the back side of the mannequin in accordance with FIG. 15.
Figure 17:
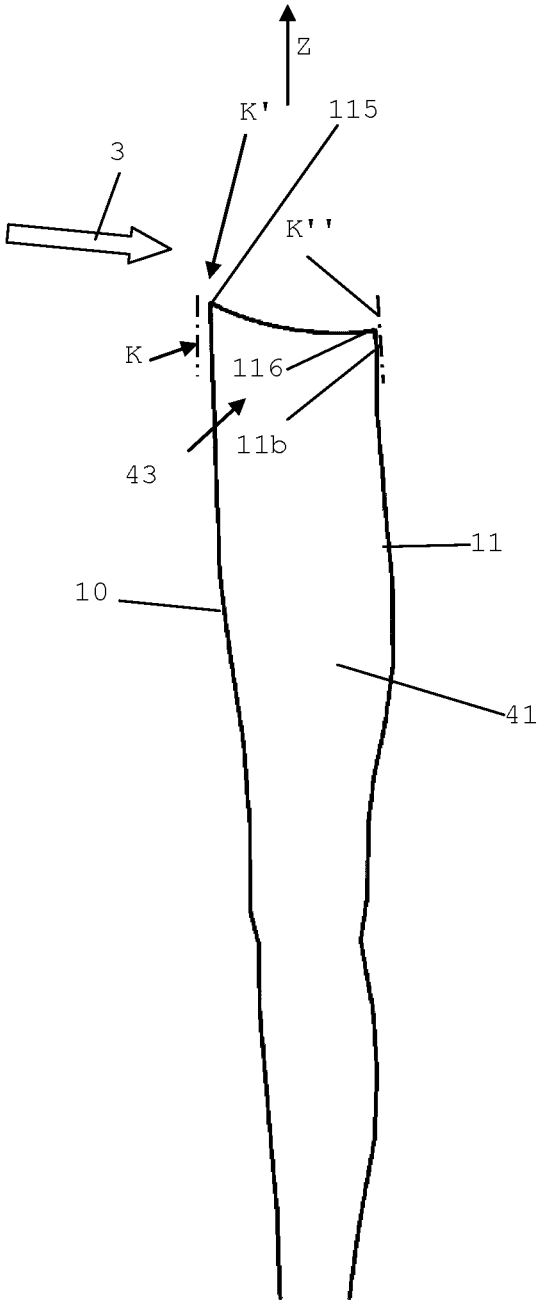
FIG. 17 shows a fragmentary, partially cut side view of the mannequin in accordance with FIGS. 15 and 16.

FIG. 15 finally shows in connection with the FIGS. 16 and 17 a mannequin 1 that has only one pelvis 33 and two legs 40, 41 extending from it along vertical line Z. A cutout 103 of the mannequin 1 is hereby defined by a circumferential pelvis area 36 of the mannequin 1, which has a first edge section 115 allocated to the front side 10 and a second edge section 116 connected with it allocated to the back side 11. The two edge sections 115, 116 together go around the at least one cutout 103 and thereby frame it. In accordance with the principle of FIGS. 13 and 14, the second edge section 116 is now bent along vertical line Z—with respect to an appropriately arranged state of the mannequin (1)—and thereby runs at least in sections below the first edge section 115 so that in particular in the case of a clothing article K (e.g. in the form of pants) arranged appropriately on the mannequin 1, which forms a clothing article cutout K' (waistband) for the pelvis/stomach of a person in the pelvis area 36, in the plan view of the front side 10 along the line of sight 3 in accordance with FIG. 17 ("diagonally from above") in the pelvis area 36, the inside K" of the clothing article K on the back side 11 of the mannequin 1 is visible, but not the mannequin (1) itself (see FIG. 17).

In accordance with FIGS. 15 and 16, an insert 74 in the shape of a pelvis section with a flat (even) cover surface is furthermore provided for closing said cutout 103, which is releasably fixable on the pelvis area 35, e.g. in accordance with FIG. 8 (see above).

The measure specified in FIG. 15 is preferably A=13 cm.

Figure 18:
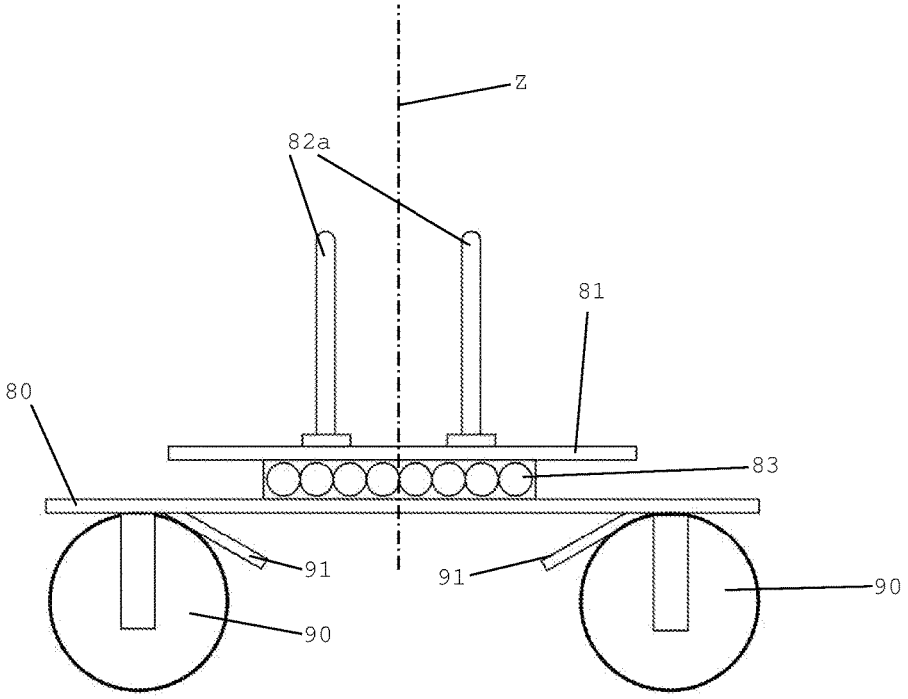
FIG. 18 shows a side view of a movable and pivotable carrier of a mannequin according to the invention.

In accordance with FIG. 18, the mannequins 1 according to the invention are preferably mounted pivotably around a vertical axis Z on a flat carrier plate 80, which extends diagonal to axis Z.

For this, two bolts (pins) 82*a* protrude from a flat turning plate 81 extending diagonal to axis Z along axis Z, via which the free ends of the legs 40, 41 of the respective mannequin 1 are fixed on the turning plate 81. For this, tubular receptacles 82*b*, into each of which one of the bolts 82*a* can be inserted for fixing the mannequin 1 on the turning plate 81, are provided on the free ends (e.g. in the shape of human feet) of the legs 40, 41 of the mannequins 1.

The turning plate 81 is in turn swivel-mounted on the carrier plate 83 via a pivot bearing 83, so that the turning plate 81 can be turned around vertical axis Z with respect to the carrier plate 80.

Rollers 90, which can be locked individually by means of brakes 91, are provided on a bottom side of the carrier plate 80 for moving the mannequin 1.

The invention claimed is:

1. A mannequin for presenting or photographing at least one clothing article arranged appropriately on the mannequin, wherein the mannequin comprises a torso having two shoulders, wherein the torso has a front side and a back side facing away from the front side, wherein, the torso has at least one cutout such that the back side of the mannequin is not visible in a plan view of the front side of the mannequin along a predefinable line of sight in the area of the at least one cutout, wherein the at least one cutout is designed in an upper area of the thorax of the torso such that the torso does not comprise a neck and is arranged between said shoulders, and wherein the mannequin has at least one insert releasably fixable in the cutout and configured to be completely removable from said cutout, which insert comprises a cutout being smaller than the cutout of the torso, and which insert is configured to be inserted into said cutout of the torso in a form fitting manner such that it rests on the torso, such that a clothing article that forms a clothing article cutout through which the neck of a person extends when the person wears said clothing article, can be arranged on the torso with said insert removed, such that no portion of the mannequin protrudes out of said clothing article cutout, and, in the case of said plan view of the front side of the mannequin, the inside of the clothing article is visible on the back side of the mannequin in the area of the cutout, but not the mannequin itself, and such that a further clothing article that forms a smaller clothing article cutout through which the neck of a person extends when the person wears said further clothing article, can be arranged on the torso with said insert inserted into the cutout of the torso, such that no portion of the mannequin protrudes out of said clothing article cutout of said further clothing article, and, in the case of said plan view of the front side of the mannequin, the inside of the further clothing article is visible on the back side of the mannequin in the area of the cutout of the insert, but not the mannequin itself.

2. The mannequin according to claim 1, wherein the front side and the back side of the mannequin each have an outward-facing, visible outside and an inside facing away from the respective outside, wherein the two insides face each other, and wherein the said at least one cutout of the torso is designed in particular such that the inside of the back side of the mannequin in the case of said plan view of the front side of the mannequin is not visible in the area of the at least one cutout.

3. The mannequin according to claim 1, wherein the at least one cutout on at least one of the front or back side of the mannequin has at least one of a bent edge section, a V-shaped edge section or a straight edge section.

4. The mannequin according to claim 1, wherein the mannequin has a circumferential neck area extending from the torso, which frames the at least one cutout, wherein in particular the neck area has a first edge section allocated to the front side and a second edge section connected with it and allocated to the back side, wherein the two edge sections frame the at least one cutout, and wherein in particular the second edge section runs along the vertical line—with respect to an appropriately arranged state of the mannequin—at least in sections below the first edge section.

5. The mannequin according to claim 1, wherein the mannequin has a plurality of inserts releasably fixable in the at least one cutout for at least one of variably reducing or changing a contour of the at least one cutout, wherein in particular a first of these inserts is releasably fixable in the at least one cutout and each further insert is releasably fixable on at least one neighboring insert.

6. The mannequin according to claim 1, wherein the insert is releasably fixable by means of a magnet connection on the mannequin.

7. The mannequin according to claim 1, wherein the mannequin is mounted pivotably around a vertical axis on a carrier plate, wherein the carrier plate has a plurality of rollers for moving the mannequin, via which the carrier plate can lie on a base, wherein in particular a turning plate is connected in a pivotable manner around a vertical axis with the carrier plate via a pivot bearing, and wherein two bolts protrude in particular from the turning plate, which are designed, in order to fasten the mannequin on the turning plate, to engage in two tubular receptacles protruding from the mannequin.

8. The mannequin according to claim 1, wherein an air movement device is provided in an internal space of the mannequin defined by the mannequin, which is designed to generate an air flow flowing out of the least one cutout.

9. A mannequin for presenting or photographing at least one clothing article arranged appropriately on the mannequin, wherein the mannequin has a front side and a back side facing away from the front side, wherein, the mannequin has at least one cutout such that the back side of the mannequin is not visible in a plan view of the front side of the mannequin along a predefinable line of sight in the area of the at least one cutout, wherein the mannequin has at least one insert releasably fixable in the cutout, which insert is configured to be inserted into the at least one cutout so as to at least one of reduce and change a contour of the at least one cutout, which in turn, together with the at least one cutout or alone, defines a smaller cutout in terms of area, and wherein said insert is configured to be completely removable from the at least one cutout, wherein the at least one cutout is designed in the area of a pelvis of the torso, wherein in particular the at least one cutout in a section on at least one of the front or back side narrows, especially tapers in a V-shaped manner, in the direction of the thorax, so that in particular in the case of a clothing article arranged appropriately on the mannequin, which forms a clothing article cutout in the area of the pelvis, in the case of the plan view of the front side of the mannequin in the area of the pelvis, the inside of the clothing article on the back side of the mannequin is visible, but not the mannequin itself, and wherein the cutout extends up to two upper thigh areas of two legs of the mannequin extending from the torso.

10. The mannequin according to claim 9, wherein the mannequin has a triangular insert for closing a part of the at least one cutout on the front side of the mannequin, wherein in particular the insert is releasably and positively fixable in the narrowing section of the at least one cutout.

11. A method for photographing a clothing article, comprising the steps of:

(a) arranging a clothing article, which has a clothing article cutout, on a mannequin comprising:

a torso having two shoulders, wherein the torso has a front side and a back side facing away from the front side, wherein the torso has at least one cutout such that the back side of the mannequin is not visible in a plan view of the front side of the mannequin along a predefinable line of sight in the area of the at least one cutout, wherein the at least one cutout is designed in an upper area of the thorax of the torso such that the torso does not comprise a neck and is arranged between said shoulders, and wherein the mannequin has at least one insert releasably fixable in the cutout and configured to be completely removable from said cutout, which insert comprises a cutout being smaller than the cutout of the torso, and which insert is configured to be inserted into said cutout of the torso in a form fitting manner such that it rests on the torso, such that a clothing article that forms a clothing article cutout through which the neck of a person extends when the person wears said clothing article, can be arranged on the torso with said insert removed, such that no portion of the mannequin protrudes out of said clothing article cutout, and, in the case of said plan view of the front side of the mannequin, the inside of the clothing article is visible on the back side of the mannequin in the area of the cutout, but not the mannequin itself, and such that a further clothing article that forms a smaller clothing article cutout through which the neck of a person extends when the person wears said further clothing article, can be arranged on the torso with said insert inserted into the cutout of the torso, such that no portion of the mannequin protrudes out of said clothing article cutout of said further clothing article, and, in the case of said plan view of the front side of the mannequin, the inside of the further clothing article is visible on the back side of the mannequin in the area of the cutout of the insert, but not the mannequin itself; and (b) photographing at least one of said clothing article or said further clothing article with said camera.

* * * * *